United States Patent [19]

Sisson et al.

[11] Patent Number: 4,733,803

[45] Date of Patent: Mar. 29, 1988

[54] PARTICULATE DISPENSING APPARATUS

[75] Inventors: Charles W. Sisson; Duane R. Kerr; Russell H. Mosier, all of Hanford, Calif.

[73] Assignee: Carnation Company, Los Angeles, Calif.

[21] Appl. No.: 877,615

[22] Filed: Jun. 23, 1986

[51] Int. Cl.[4] ..... F16K 3/36; B65B 43/42; B67C 3/00

[52] U.S. Cl. ..... 222/276; 137/246.11; 141/157; 221/264; 222/361

[58] Field of Search ..... 222/361, 362, 354, 344, 222/409, 367, 372, 600, 305, 504, 276; 221/263, 264; 141/156–157; 137/246, 246.11, 246.12, 246.22

[56] References Cited

U.S. PATENT DOCUMENTS

| | | | |
|---|---|---|---|
| 2,033,586 | 3/1936 | Noble | 222/504 X |
| 2,296,081 | 9/1942 | Aspin | 137/246 |
| 2,315,473 | 3/1943 | Wolcott | 222/372 X |
| 2,639,837 | 5/1953 | Stockdale | 222/276 |
| 2,951,618 | 9/1960 | Aldecoa | 141/156 X |
| 3,314,575 | 4/1967 | Graham | 222/330 |
| 3,623,639 | 11/1971 | McShirley | 222/361 X |
| 4,164,244 | 8/1979 | Meier | 141/156 |
| 4,295,409 | 10/1981 | Simpson | 222/305 X |
| 4,403,715 | 9/1983 | Ludovissie | 222/361 |

FOREIGN PATENT DOCUMENTS 57-152366 9/1982 Japan .

*Primary Examiner*—Robert J. Spar
*Assistant Examiner*—P. McCoy Smith

[57] ABSTRACT

A dispensing apparatus adapted to be mounted over a can line for dispensing metered amounts of particulate material into cans in a high speed canning operation. The dispenser utilizes a metering unit which includes a reciprocating slide bar having a pair of spaced chambers, one of which is moved into a loading position and the other of which is moved into a discharge position during each reciprocation of the slide bar. A can detecting device and an air pressure operated actuating valve are provided to control reciprocating movement of the slide bar in response to the presence and speed of cans carried on the can line beneath the dispenser. Lubricating conduits are provided in the metering unit to ensure free movement of the slide bar.

3 Claims, 5 Drawing Figures

10
14
15
18
24
25
26
28
29
30
31
32
33
35
36
37
38
41
42
43
44
45
46
47
50
51
52
5

PARTICULATE DISPENSING APPARATUS

BACKGROUND OF THE INVENTION

This invention relates to a dispensing device for particulate materials. More particularly, the invention relates to an apparatus for accurately dispensing metered quantities of particulate material, such as a mixture of coarse, granular herbs and spices, into containers in a high speed commercial production operation.

In the production of a number of canned fruit and vegetable products, a variety of herbs and/or spices are frequently included in the canned product by introducing measured quantities of the dry particulate material into cans during the production operation. Such production operations are typically carried out at high production speeds, which may vary from time to time, for extended periods of time. As a result, it is essential that all equipment used in filling ingredients into cans in such operations be capable of dispensing accurate quantities of the ingredient at high rates, be capable of operating effectively over extended periods of time, and be responsive to changes in the line speed of the cans. Dispensing devices available heretofore for dispensing particulate herbs and spices have not been completely satisfactory, particularly in their ability to dispense accurate amounts of material at high rates of speed over extended periods of time. In addition, prior dispensing devices require periodic shut-down for maintenance, repair and/or cleanup.

SUMMARY OF THE INVENTION

The dispensing apparatus of the present invention is adapted to dispense metered amounts of a particulate material into cans being carried on an endless conveyor in a high speed commercial canning operation. The present invention provides a novel dispensing device which is not only of relatively simple and inexpensive construction, but one which functions in an efficient manner and is capable of operating at high production line speeds over extended periods of time.

The dispenser utilizes a metering unit which includes a slide bar, having a pair of chambers, which is mounted for reciprocating movement between two operative positions. During each reciprocal movement of the slide bar one of the chambers is moved into alignment with a loading port to load the particulate material into the chamber, while the other chamber is moved into alignment with a discharge port to discharge the particulate mix therein into a can being carried underneath the dispenser. A can sensing device and an actuating valve are provided to control reciprocatory movement of the slide bar in response to the presence and speed of cans carried beneath the dispenser. Lubricating means are provided in the metering unit to ensure free movement of the slide bar.

DESCRIPTION OF THE INVENTION

Figure 1:
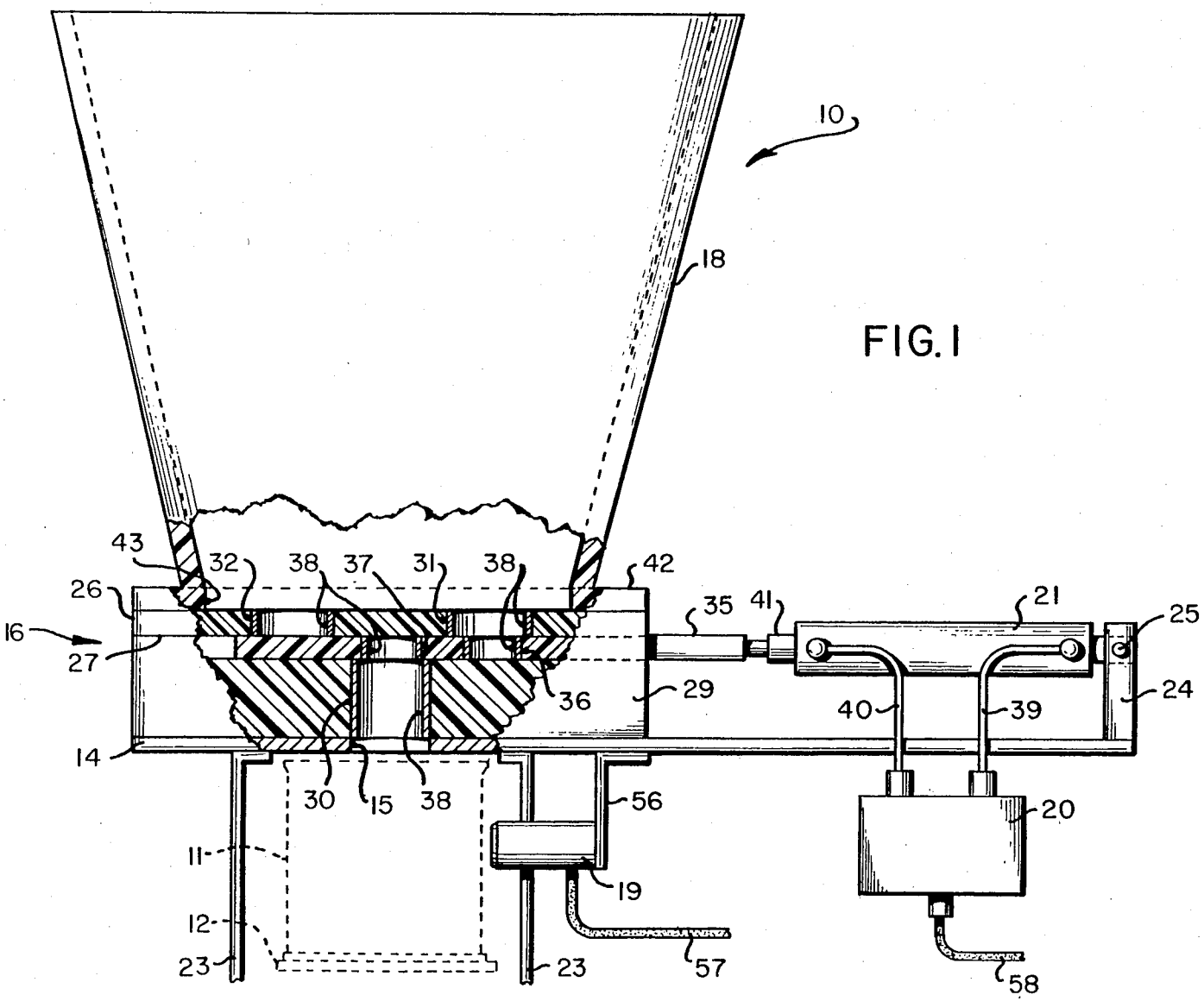
FIG. 1 is a side elevation partly in section of the dispensing apparatus of the present invention showing the apparatus mounted above a can line.

Referring now to the drawings, the dispensing apparatus of the present invention is generally denoted by reference numeral 10. Although the dispenser may be used to dispense any granular or particulate material, it is particularly adapted for use in dispensing metered amounts of herbs and/or spices into cans in a high speed canning operation, such as in the commercial production of canned fruit or vegetable products.

The dispensing apparatus 10 is adapted to be mounted above a can line on which metal cans 11 are carried on an endless conveyor 12 in a high speed canning operation, into which a measured volume of the particulate mix of herbs and/or spices is to be deposited. The dispenser 10 includes a rigid mounting plate 14 having an opening 15 therein which is positioned above the can line. A metering unit 16 which includes a reciprocating slide dispenser 35, is mounted on plate 14 for controlling the amount of particulate material dispensed in the cans. A hopper 18, in which the particulate material to be dispensed is stored, is mounted on the metering unit. The dispensing operation is effected automatically by means of a magnetic sensor 19 mounted adjacent the can line and an actuating valve 20 which controls the reciprocating movement of slide dispenser 35 through air cylinder 21.

As shown in FIG. 1, rigid mounting plate 14 is secured over the can line by any suitable means so that the bottom surface of plate 14 is maintained a short distance, i.e. on the order of about ¼", above the can tops, and the mounting plate opening 15 is positioned over the center of the cans. For example, plate 14 may be secured in position by a pair of mounting brackets 23 which are attached at their lower ends to the frame carrying the endless conveyor 12, and attached at their upper ends to the bottom surface of plate 14.

A pair of upstanding support brackets 24 are mounted on the upper surface of plate 14 at one end thereof, and an air cylinder mounting pin 25 is secured to and extends between the support brackets.

Figures 2, 5:
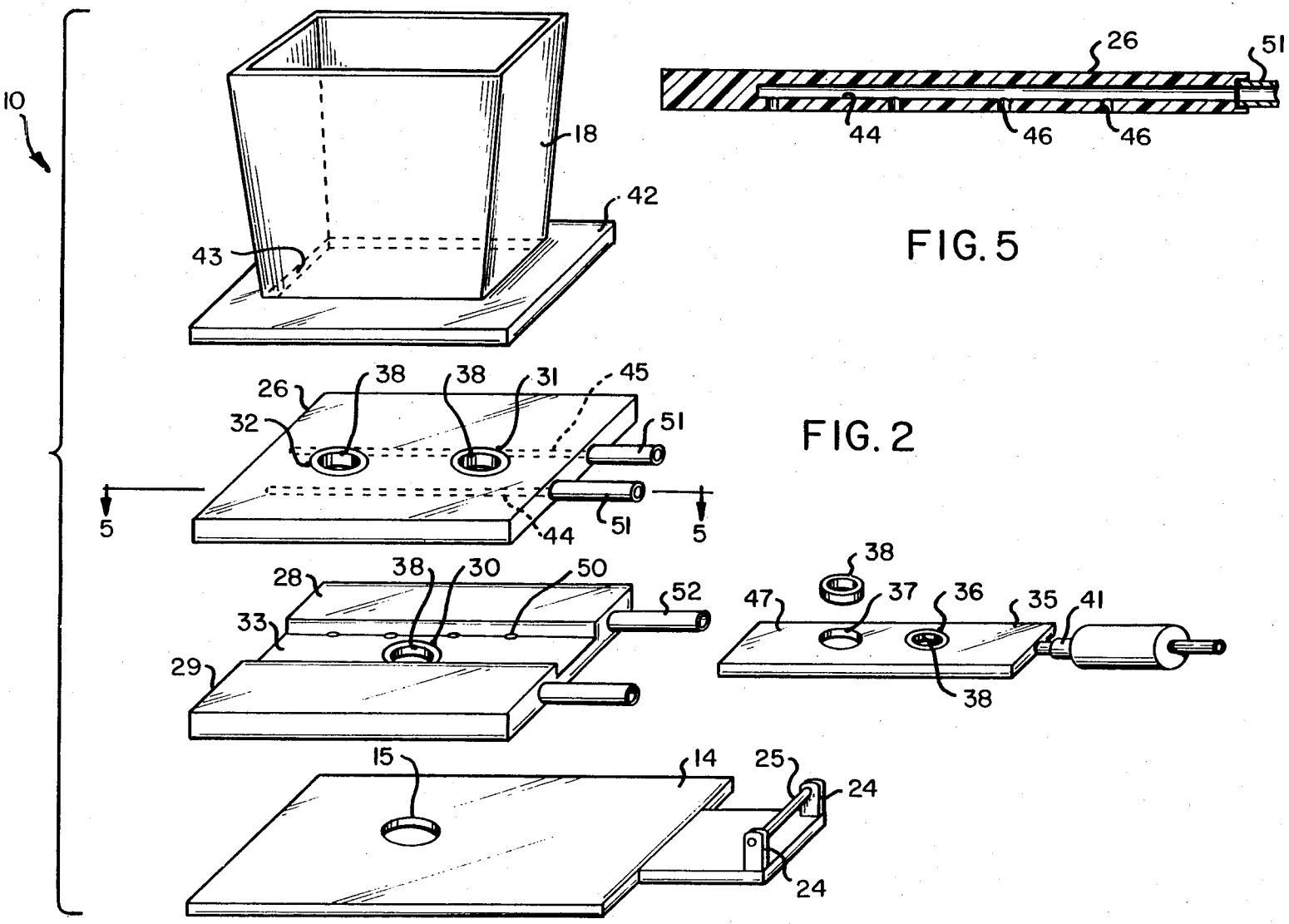
FIG. 2 is an exploded perspective view of the dispensing apparatus.
FIG. 5 is a sectional view of the loading plate taken along line 5—5 of FIG. 2.

Referring now to FIGS. 1 and 2, it will be observed that the metering unit generally referred to by reference numeral 16 includes a generally rectangular loading plate 26 having a flat planar bottom surface 27 which is mounted on the flat planar upper surface 28 of support block 29. Support block 29 has a centrally located discharge opening 30 which has a size and shape corresponding to a pair of longitudinally spaced loading openings 31 and 32 in loading plate 26, with the discharge opening 30 being positioned midway between openings 31 and 32 when the loading plate and support block are secured together. The support block 29 is fixed to the upper surface of the mounting plate 14 so that the discharge opening 30 is aligned with opening 15 in the mounting plate. A longitudinal channel 33 having a substantially flat bottom wall is provided in the upper surface 28 of support block 29, with the channel extending across the support block over discharge opening 30 and beneath loading openings 31 and 32 in the loading plate.

The metering unit also includes an elongated, generally rectangular, flat slide dispenser bar 35 which is mounted for reciprocating movement in longitudinal channel 33. The dimensions of slide bar 35 are such that when the slide bar is positioned in channel 33, the upper surface of the slide bar is coplanar with the upper surface 28 of the support block, and the side walls of the slide bar are disposed in a mating manner with the side walls of the channel. The slide dispenser bar 35 is provided with a pair of metering openings 36 and 37 which are longitudinally spaced apart by a distance of one-half the distance between loading openings 31 and 32. In this manner, when one of the metering openings 36 or 37 is disposed in registering relation with one of the loading openings 31 or 32, the other metering opening in the slide bar will be disposed in registering relation with discharge opening 30 in the support block. It will also be appreciated that the volumetric space defined by each metering opening 36 or 37 in the slide bar defines the quantity or amount of particulate material to be dispensed into the cans. Preferably, a stainless steel bushing 38 is fitted into each of the openings 30, 31, 32, 36 and 37 to prevent erosion at the edges of the opening due to reciprocatory movement of the slide bar.

An air cylinder 21 is secured to one longitudinal end of the slide bar 35 by means of piston rod 41 to effect reciprocating movement of the slide bar in channel 33. Fluid pressure lines 39 and 40 are connected to the air cylinder to produce reciprocatory movement of piston rod 41. The piston rod undergoes a relatively short reciprocatory stroke in order to operate the slide bar, and is connected thereto by any suitable means. The end of the air cylinder remote from the slide bar is secured to mounting pin 25 which extends between support brackets 24.

The particulate material to be dispensed is stored in hopper 18 which is generally rectangular in shape and which may be provided with a removable top cover (not shown). Preferably the walls of the hopper taper downwardly, with the bottom ends of the hopper walls being secured to rectangular base plate 42 around the periphery of opening 43 in the base plate. The base plate is mounted on the upper surface of loading plate 27 so that hopper opening 43 extends over loading openings 31 and 32. Preferably the hopper is constructed of clear plastic material to permit observation of the level of particulate material in the hopper. However, any suitable material, such as sheet metal may be used.

Figure 3:
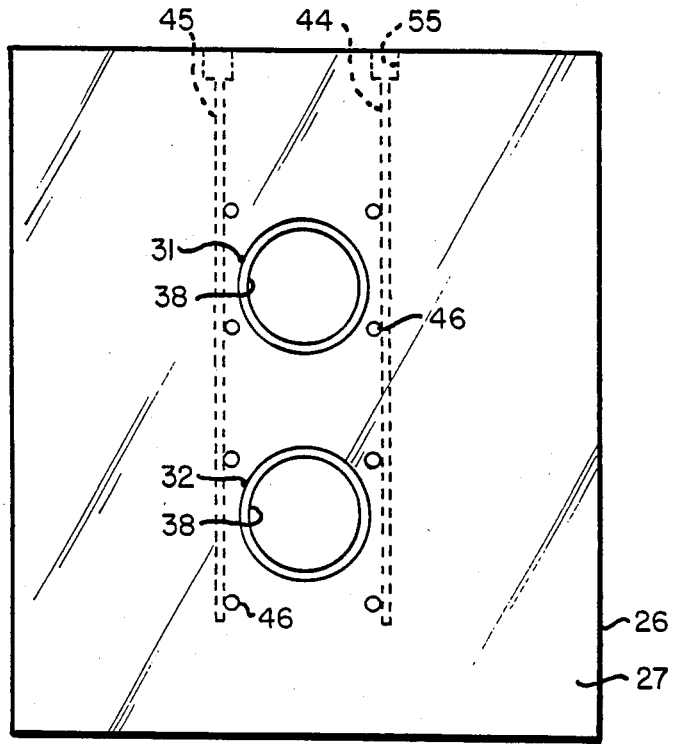
FIG. 3 is a bottom plan view of the loading plate of the dispenser.

Since the dispensing apparatus of this invention is intended to be used in a high speed canning operation over extended periods of time, the components of the metering unit preferably are molded from an inert plastic material, such as nylon molding powder, which has good dimensional stability, good abrasion resistance and good resistance to friction In order to facilitate the reciprocatory movement of the slide bar 35 in channel 33, the metering unit is constructed to permit lubrication of the exterior surfaces of the slide bar during use. Thus, as shown in FIGS. 3 and 5, a pair of parallel longitudinal bores 44 and 45 are provided in loading plate 26, such as by drilling a small diameter tubular bore into the loading plate adjacent the loading openings 31 and 32. A plurality of spaced apertures 46, which communicate with longitudinal bores 44 and 45, are provided in the bottom surface of the loading plate in that portion of the loading plate which is directly above slide bar 35. Preferably, apertures 46 are formed in the bottom surface of loading plate 26 directly above the upper longitudinal edges 47 of the slide bar when the slide bar is disposed in channel 33 and the loading plate mounted on the support block.

Figure 4:
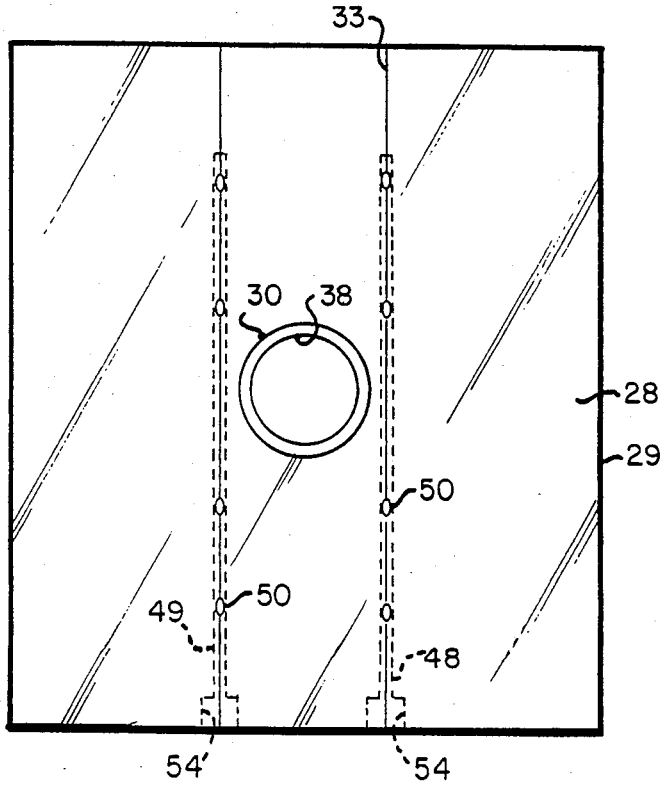
FIG. 4 is a top plan view of the support block of the dispenser.

Similarly, as shown in FIG. 4, a pair of parallel, longitudinal bores 48 and 49 are provided in support block 29 below the bottom surface of the channel 33. A plurality of spaced apertures 50, which communicate with conduits 48 and 49, are provided in the channel 33, preferably at or near the longitudinal edges of the channel. A suitable lubricating fluid, such as mineral oil, vegetable oil, and the like, is pumped from a supply tank (not shown) by compressed air through supply lines 51 and 52 into bores 44, 45, 48 and 49 and through apertures 46 and 50 to lubricate the exterior surfaces of slide bar 35 as it reciprocates in the channel. Supply lines 51 and 52 are secured to the loading plate and support block respectively by any suitable means, such as by screw threads provided on the enlarged sections 54 and 55 formed at the outer ends of the longitudinal bores.

The dispensing apparatus also includes means for actuating the slide bar in response to the presence and line speed of cans passing underneath discharge opening 15. Thus, a conventional magnetic sensor 19 connected by line 57 to an electro-pneumatic control panel (not shown) is mounted on bracket 56 under mounting plate 14, adjacent the can line, a short distance upstream of the opening 15. Air actuating valve 20, connected to the control panel by air line 58, serves to actuate air cylinder 21 by means of air pressure lines 39 and 40 to produce reciprocatory movement of the slide bar, causing the slide bar to move between two operative positions, namely a retracted position (as shown in FIG. 1) and an extended position.

When the slide bar is in a retracted position, the particulate material to be dispensed flows by gravity from the hopper into both loading openings 31 and 32 in the loading plate and fills metering opening 36 on the slide bar. When the slide bar is moved to its extended position, due to actuation of the air cylinder in response to movement of a can under the dispenser, the movement of the slide bar is such that metering opening 36 is moved into alignment with discharge opening 30 and opening 15, and the particulate material in metering opening 36 is discharged into a can moving under opening 15. Concurrently, metering opening 37 is aligned with loading opening 32 in the loading plate so that the particulate material fills metering opening 37. As another can is carried under the dispenser, the air cylinder is again actuated to move the slide bar to its retracted position in which metering opening 37 is moved into alignment with openings 30 and 15 and the particulate is discharged into the can. This cycle is repeated in response to every movement of a can on the can line being carried beneath the dispensing apparatus.

While the preferred embodiments of the present invention have been described, it will be understood that various changes, adaptations and modifications may be made therein without departing from the spirit of the invention and the scope of the appended claims.

What is claimed is:

1. A particulate dispensing device adapted to be mounted over a can line for dispensing metered amounts of particulate material into cans, which comprises a mounting plate having an opening therethrough;

a metering unit mounted on said mounting plate, said metering unit comprising (a) a support block having substantially flat upper and lower surfaces, secured on said mounting plate, said support block having a central discharge opening therein aligned with the opening in said mounting plate, and having a longitudinal channel with a substantially flat bottom wall extending across the upper surface thereof over said discharge opening, (b) a loading plate secured on the upper surface of said support block extending over said channel and having a pair of longitudinally spaced loading openings extending therethrough communicating with said channel, and (c) an elongated slide dispenser having substantially flat upper and lower surfaces slidably mounted for reciprocatory longitudinal movement in said longitudinal channel, said slide dispenser having a pair of metering openings extending therethrough spaced apart by a distance equal to one-half the distance between said loading openings, with said metering openings being positioned so that one of said metering openings registers with the discharge opening when the other metering opening registers with a loading opening, actuating means associated with said slide dispenser to effect longitudinal reciprocatory movement of the slide dispenser in said longitudinal channel;

can sensor means mounted adjacent the opening in said mounting plate;

valve means operatively associated with said can sensor means and said actuating means to control movement of said actuating means, and at least one conduit means extending longitudinally into the metering unit parallel to said longitudinal channel communicating with a plurality of openings in the metering unit adjacent said slide dispenser, said conduit means being adapted to convey a lubricating fluid under pressure to at least one of the surfaces of the slide dispenser said conduit means includes a pair of substantially parallel longitudinal bores in said support block adjacent the bottom wall of said channel, said bottom wall of the channel having a plurality of openings therein communicating with said longitudinal bores in said support block, and means for introducing a lubricating fluid under pressure into said longitudinal bores in said support block, and said conduit means also includes a pair of substantially parallel longitudinal bores in said loading plate, with the bottom surface of the loading plate having a plurality of apertures therein above said channel communicating with said longitudinal bores in said loading plate, and means for introducing a lubricating fluid under pressure into the longitudinal bores in said loading plate.

2. The dispensing device defined in claim 1 in which said actuating means comprises an air cylinder mounted on said mounting plate adjacent one end of said slide dispenser, having a piston rod connected to said end of the slide dispenser, and a pair of fluid pressure lines connected to said air cylinder and said valve means to produce reciprocatory movement of the piston rod and said slide dispenser.

3. The dispensing device defined in claim 1 in which a wear-resistant bushing is mounted in said loading openings, metering openings and discharge opening.

* * * * *